US006106672A

United States Patent [19]

Dodds

[11] Patent Number: 6,106,672

[45] Date of Patent: Aug. 22, 2000

[54] ADJUSTABLE HEIGHT FORMING BLADE APPARATUS

[75] Inventor: James Dodds, St. Lazare, Canada

[73] Assignee: Beloit Technologies, Inc., Wilmington, Del.

[21] Appl. No.: 09/007,659

[22] Filed: Jan. 15, 1998

[51] Int. Cl.[7] ..... D21F 1/44; D21F 1/32

[52] U.S. Cl. ..... 162/312; 162/199; 162/272

[58] Field of Search ..... 162/199, 272, 162/312

[56] References Cited

U.S. PATENT DOCUMENTS 3,629,057 12/1971 McKie ..... 162/312

4,447,296 5/1984 Cruse ..... 162/312

*Primary Examiner*—Christopher A. Fiorilla

*Attorney, Agent, or Firm*—Lathrop & Clark LLP

[57] ABSTRACT

An adjustable blade apparatus including an operative surface which cooperates with a forming wire of a forming section. The apparatus includes a stationary support which extends in a cross machine direction relative to the forming wire. The support defines a guide rail having a front and a back end. The front end is disposed at a different elevation relative to the back end. The arrangement is such that the guide rail slopes in a cross machine direction. A blade defines the operative surface and the blade cooperates with the guide rail such that the blade is adjustably supported by the support. The arrangement is such that relative cross machine directional movement between the guide rail and the blade adjust the elevation of the operative surface relative to the wire.

11 Claims, 1 Drawing Sheet

ADJUSTABLE HEIGHT FORMING BLADE APPARATUS

BACKGROUND OF THE INVENTION

1. Field of the Invention

The present invention relates to an adjustable blade apparatus having an operative surface which cooperates with a forming wire of a forming section. More specifically, the present invention relates to an adjustable blade apparatus which permits adjustment of the distance of an operative surface of a forming blade relative to a forming wire.

2. Information Disclosure Statement

In the papermaking art, stock is ejected from a headbox onto a forming wire of a forming section such that water within the stock is permitted to drain through the forming wire leaving a mat of damp fibers on the moving surface of the forming wire.

Typically, the forming wire moves over the surface of a plurality of forming blades which assist in the removal of water from the stock through the forming wire. Each blade includes an operative surface which comes into physical contact with the side of the forming wire disposed opposite the stock. Usually, such blades are formed from ceramic material for reducing frictional wear that would occur between the moving forming wire and the stationary blade.

Although in the prior art, forming sections typically include a single forming wire or fourdrinier wire, more recently, twin wire formers have been built in which stock is ejected into a forming section defined between cooperating wires of the aforementioned twin wire formers.

In a twin wire former, blades are located within the respective loops of each forming wire with such blades being disposed adjacent to each other. Consequently, there exists a need to accurately adjust the height of the operative surface of each blade relative to the adjacent supported wire. For example, in the case of a Bel Baie III Twin Wire Former, a gap of 0.62 inches exists between adjacent blades. The aforementioned distance or gap between the adjacent blades that the height of each operative surface of each blade must be the same to within a height tolerance within a range + or −0.0015 inches.

A blade of the aforementioned type is typically supported by support means rigidly secured to a framework so that each machine part is built to a particular tolerance. Accordingly, it is not uncommon in view of the number of parts involved for the blade to be supported within a tolerance of the order + or −0.011 inches.

Therefore, in order to obtain the aforementioned required tolerance within the range + or −0.0015 inches, it becomes necessary to carefully add shims every 12 inches across the machine in order to adjust the operative surface to within the required tolerance.

Such shimming or adjusting of the blades for the aforementioned Bel Baie III Former or a Bel Bond retrofit unit would cost in the order of $40,000. Bel Baie and Bel Bond are required trademarks of Beloit Corporation.

The present invention provides means for achieving an adjustable height blade by the provision of a sloping rail to which the blade is affixed.

For example, when the sloping rail of a stationary support means slopes from front to back, a distance of 0.002 inches per inch in a cross machine direction the distance between the operative surface of the blade and the wire can be adjusted 0.006 inches by moving the blade 3 inches in an axial direction along the rail.

Therefore, it is a primary objective of the present invention to provide an adjustable blade apparatus which overcomes the aforementioned inadequacies of the prior art arrangements and which makes a considerable contribution to the art of forming a paper web in a forming section.

Other objects and advantages of the present invention will be readily apparent to those skilled in the art from a consideration of the detailed description taken in conjunction with the annexed drawings.

SUMMARY OF THE INVENTION

The present invention relates to an adjustable blade apparatus having an operative surface which cooperates with a forming wire of a forming section. The apparatus includes a stationary support means which extends in a cross machine direction relative to the forming wire. The support means defines a guide rail having a front and a back end. The front end is disposed at a different elevation relative to the back end such that the rail slopes in a cross machine direction.

A blade defines the operative surface and cooperates with the guide rail such that the blade is adjustably supported by the support means. The arrangement is such that relative cross machine directional movement between the guide rail and the blade adjusts the elevation of the operative surface relative to the wire.

In a more specific embodiment of the present invention, the blade apparatus further includes a frame, with the support means being rigidly secured to the frame such that the support means extends in a cross machine direction across the entire width of the forming wire.

The guide rail defines a uniform angle of inclination from the front of the back end thereof relative to the frame.

The guide rail is of T-shaped cross sectional configuration for guiding the blade.

The guide rail slopes in a cross machine direction relative to the wire. The arrangement is such that for each consecutive inch in a cross machine direction, the distance between the guide rail and the wire has a differential within a range 0.000–0.010 inches.

Additionally, the blade further defines a T-shaped undercut portion which cooperates with the T-shaped configuration of the guide rail such that the blade is adjustably captivated by the guide rail. The blade is movable in a cross machine direction relative to the guide rail so that the distance between the operative surface and the wire is adjustable.

The blade cooperates with the guide rail such that when the blade is moved in a cross machine direction relative to the guide rail, the operative surface remains parallel to the forming wire while a distance between the operative surface and the forming wire is adjustable.

Furthermore, the blade as a front and a rear extremity. The distance in a cross machine direction between the extremities is greater than a further distance between the front and the back ends of the guide rail. The arrangement is such that the extremities protrude from the front and back ends of the guide rail for permitting axial movement of the blade for effecting adjustment of the operative surface relative to the wire.

The aforementioned distance is greater than the further distance by an amount within the range 1–24 inches.

Additionally, the adjustable blade apparatus according to the present invention further includes locking means for locking the blade relative to the guide rail when the required distance between the operative surface and the wire has been attained.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

DETAILED DESCRIPTION OF THE DRAWINGS

Figure 1:
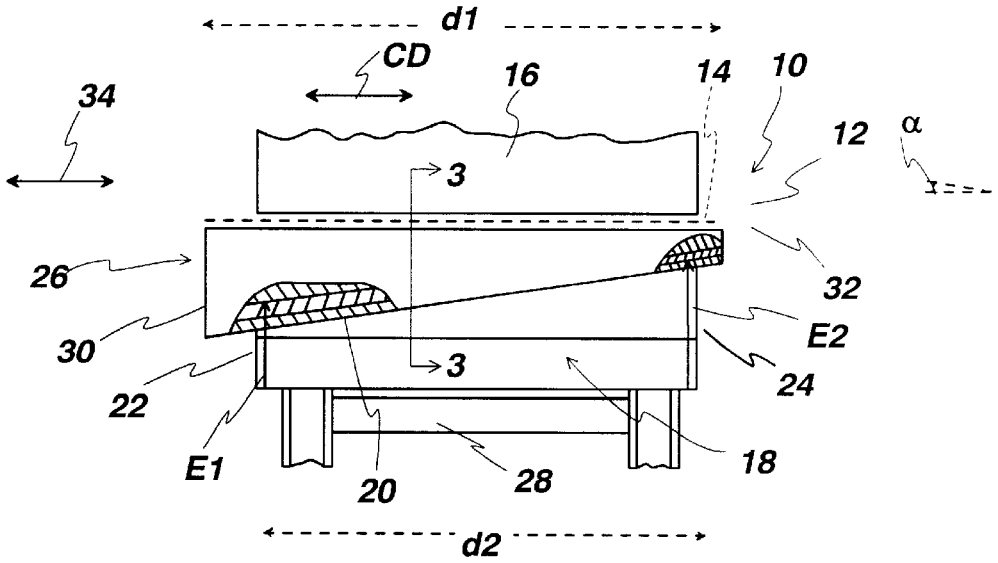
FIG. 1 is an elevational view partially in section of an adjustable blade apparatus according to the present invention.

FIG. 1 is a side elevational view of an adjustable blade apparatus generally designated 10 according to the present invention. The apparatus 10 includes an operative surface 12 which cooperates with a forming wire 14 of a forming section 16. The apparatus 10 includes a stationary support means generally designated 18 extending in a cross machine direction as indicated by the arrow CD relative to the forming wire 14. The support means 18 defines a guide rail 20 having a front and a back end 22, 24, respectively. The front end 22 is disposed at a different elevation E1 relative to the elevation E2 of the back end 24 such that the guide rail 20 slopes in the cross machine direction CD.

A blade generally designated 26 defines the operative surface 12. The blade 26 cooperates with the guide rail 20 such that the blade 26 is adjustable supported by the support means 18. The arrangement is such that relative cross machine directional movement as indicated by the arrow 34 between the guide rail 20 and the blade 26 adjusts the distance D1 of the operative surface 12 relative to the wire 14.

The apparatus 10 also includes a frame 28. The arrangement is such that the support means 18 is rigidly secured to the frame 28 so that the support means 18 extends in a cross machine direction CD across the entire width of the forming wire 14.

The guide rail 20 defines a uniform angle of inclination a from the front end 22 to the back end 24 thereof relative to the frame 28.

The guide rail 20 is of T-shaped cross sectional configuration for guiding the blade 26.

Additionally, the guide rail 20 slopes in a cross machine direction CD relative to the wire 14. The arrangement is such that for each consecutive inch in a cross machine direction, the distance between the guide rail 20 and the wire 14 has a differential within a range 0.000–0.010 inches.

Figure 2:
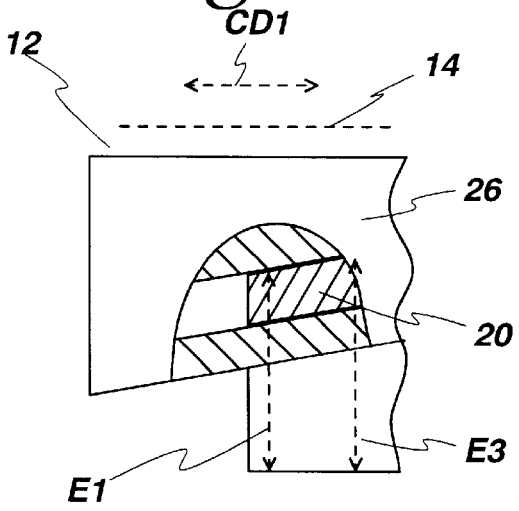
FIG. 2 is an enlarged fragmentary view of the apparatus shown in FIG. 1.

For example, FIG. 2 is an enlarged view of the left hand portion of FIG. 1 and shows a portion of the blade 26 and the guide rail 20.

More particularly, for a cross machine directional distance of one inch shown as CD1 in FIG. 2, the elevation of the guide rail 20 increases from a value E1 to a value E3. E3 being greater than E1 by a distance of for example 0.002 inches.

Figure 3:
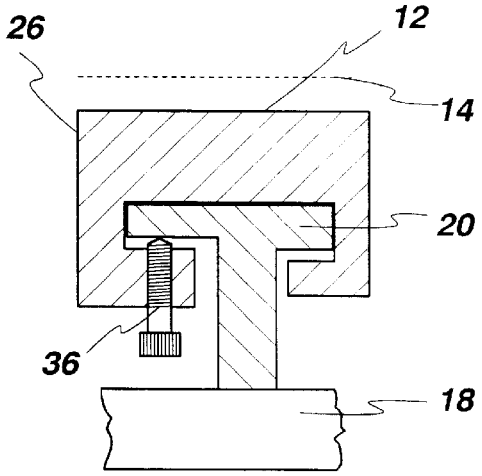
FIG. 3 is an enlarged sectional view taken on the line 3—3 of FIG. 1.

FIG. 3 is a sectional view taken on the line 3—3 of FIG. 1. FIG. 3 shows the blade 26 as defining a T-shaped undercut section 27 which cooperates with the T-shaped configuration of the guide rail 20 such that the blade 26 is adjustably captivated by the guide rail 20. The blade 26 is movable in a cross machine direction CD relative to the guide rail 20 so that the distance D1 between the operative surface 12 and the wire 14 is adjustable.

The blade 26 cooperates with the guide rail 20 such that when the blade 26 is moved in a cross machine direction CD relative to the guide rail 20, the operative surface 12 remains parallel to the forming wire 14 while a distance D1 between the operative surface 12 and the forming wire 14 is adjustable.

The blade 26 has a front extremity 30 and a rear extremity 32. A distance d1 in a cross machine direction CD between the extremities 30 and 32 is greater than a further distance d2 between the front end 22 and the back end 24 of the guide rail 20. The arrangement is such that the extremities 30, 32, respectively protrude from the front and back ends 22, 24, respectively for permitting axial movement of the blade 26 as indicated by the arrow 34 for effecting adjustment of the operative surface 12 relative to the wire 14.

The distance d1 is greater than the further distance d2 by an amount within the range 1–24 inches. Preferably, the extremities 30, 32 protrude 6 inches each relative to the respective front and back ends 22, 24 of the guide rail 20.

The adjustable blade apparatus 10 additionally includes locking means 36 for locking the blade 26 relative to the guide rail 18 as shown in FIG. 3.

In operation of the apparatus according to the present invention, the blade 26 is captivated relative to the stationary support 18. The support 18 defines the guide rail 20 which slopes in a cross machine direction.

When the blade 26 is moved in a cross machine direction CD relative to the stationary support 18, the blade 26 cooperates with the guide rail 20 and slides thereon so that the operative surface 12 moves towards or away from the forming wire 14 according to the direction of movement in a cross machine direction of the blade 26. However, the operative surface 12 always remains parallel to the wire 14 regardless of the distance D1 between the operative surface 12 and the wire 14.

The present invention provides a simple and inexpensive means for securing a blade relative to a forming wire so that the blade can be accurately adjusted relative to the wire.

Additionally, the present invention permits adjustment of each blade such that the operative surfaces thereof are either disposed in a plane or disposed along a curved path.

What is claimed is:

1. An adjustable blade apparatus, said blade apparatus having an operative surface which cooperates with a forming wire of a forming section, said apparatus comprising:

a stationary support means extending in a cross machine direction relative to the forming wire, said support means defining a guide rail having a front and a back end, said front end being disposed at a different elevation relative to said back end such that said guide rail slopes in a cross machine direction; and a blade defining the operative surface, said blade cooperating with said guide rail such that said blade is adjustably supported by said support means, such that relative cross machine directional movement between said guide rail and said blade adjusts elevation of the operative surface relative to the wire.

2. An adjustable apparatus as set forth in claim 1 further including:

a frame;

said support means being rigidly secured to said frame such that said support means extends in a cross machine direction across an entire width of the forming wire.

3. an adjustable blade apparatus as set forth in claim 2 wherein said guide rails defines a uniform angle of inclination from said front end to said back end thereof relative to said frame.

4. An adjustable blade apparatus as set forth in claim 1 wherein said guide rail is of T-shaped cross sectional configuration for guiding said blade.

5. An adjustable blade apparatus as set forth in claim 4 wherein said blade further defines a T-shaped undercut section which cooperates with said T-shaped configuration of said guide rail such that said blade is adjustably captivated by said guide rail, said blade being movable in a cross machine direction relative to said guide rail so that the distance between the operative surface and the wire is adjustable.

6. An adjustable blade apparatus as set forth in claim 5 wherein said blade cooperates with said guide rail such that when said blade is moved in a cross machine direction relative to said guide rail, the operative surface remains parallel to the forming wire while a distance between the operative surface and the forming wire is adjustable.

7. An adjustable blade apparatus as set forth in claim 1 wherein said guide rail slopes in a cross machine direction relative to the wire, the arrangement being such that for each consecutive inch in a cross machine direction, the distance between said guide rail and the wire has a differential within a range 0.000–0.010 inches.

8. An adjustable blade apparatus as set forth in claim 1 wherein said blade has a front and a rear extremity, a distance in a cross machine direction between said extremities being greater than a further distance between said front end and said back end of said guide rail, the arrangement being such that said extremities protrude from said front and back ends for permitting axial movement of said blade for effecting adjustment of the operative surface relative to the wire.

9. An adjustable blade apparatus as set forth in claim 8 wherein said distance is greater than said further distance by an amount within a range of 1–24 inches.

10. An adjustment blade apparatus as set forth in claim 1 further including:

locking means for locking said blade relative to said support means.

11. An adjustable blade apparatus, said blade apparatus having an operative surface which cooperates with a forming wire of a forming section, said apparatus comprising:

a stationary support means extending in a cross machine direction relative to the forming wire, said support means defining a guide rail having a front and back end, said front end being disposed at a different elevation relative to said back end such that said guide rail slopes in a cross machine direction;

a blade defining the operative surface, said blade cooperating with said guide rail such that said guide rail such that said blade is adjustably supported by said support means, such that relative cross machine directional movement between said guide rail and said blade adjusts elevation of the operative surface relative to the wire; and said blade cooperating with said guide rail such that when said blade is moved in a cross machine direction relative to said guide rail, the operative surface remains parallel to the forming wire while a distance between the operative surface and the forming wire is adjustable.

* * * * *